United States Patent [19]

Wolff

[11] Patent Number: 4,482,152

[45] Date of Patent: Nov. 13, 1984

[54] EXERCISE EQUIPMENT

[76] Inventor: Leslie C. Wolff, P.O. Box 188, Hackensack, Minn. 56452

[21] Appl. No.: 434,166

[22] Filed: Oct. 13, 1982

[51] Int. Cl.[3] ..... A01B 21/00

[52] U.S. Cl. ..... 272/130; 272/134

[58] Field of Search ..... 272/130, 118, 134, 129, 272/132; 73/279, 280, 281

[56] References Cited

U.S. PATENT DOCUMENTS

| | | | |
|---|---|---|---|
| 3,465,592 | 9/1969 | Perrine | 272/130 |
| 3,572,700 | 3/1971 | Mastropaolo | 272/129 |
| 3,599,974 | 8/1971 | Price | 272/132 |
| 3,606,318 | 9/1971 | Gilstrap | 272/130 |
| 3,702,188 | 11/1972 | Phillips | 272/130 |
| 3,791,645 | 2/1974 | Stelma | 272/129 |
| 3,822,599 | 7/1974 | Brentham | 73/379 |
| 3,912,261 | 10/1975 | Lambert | 272/118 |
| 4,050,310 | 9/1977 | Keiser | 272/130 |
| 4,066,259 | 1/1978 | Brentham | 272/94 |
| 4,185,818 | 1/1980 | Brentham | 272/130 |
| 4,240,627 | 12/1980 | Brentham | 272/130 |
| 4,247,098 | 1/1981 | Brentham | 272/130 |
| 4,254,949 | 3/1981 | Brentham | 272/130 |
| 4,258,913 | 3/1981 | Brentham | 272/67 |

OTHER PUBLICATIONS

Dyna Cam–Advertising brochure of Dynamics Health Equip. Mfg. Co. Inc. 1979.

*Primary Examiner*—Richard J. Johnson

*Attorney, Agent, or Firm*—Kinney & Lange

[57] ABSTRACT

Equipment for exercising the muscles of a user includes a horizontally extending main frame and bench, an elevator leg supporting an elevator carriage for vertical movement with respect thereto situated at one end of the bench, an endless chain extending from the top to the bottom of the elevator leg and means to attach the elevator carriage to the main chain at appropriate heights. Actuating arms can be temporarily fixedly mounted to the elevator carriage so that a user can make repetitive movement in upward or downward direction on those arms. A chain sprocket driven by the endless drive chain drives a pinion which drives a rack/piston rod forming part of a piston/cylinder positive displacement linear pump. A path is provided between the opposite ends of the pump, and means is provided in the path to restrict the flow of fluid thus to provide resistance to repetitive movements of the user on the actuating arms in one direction.

4 Claims, 8 Drawing Figures

36
12
26
30
32
34
124
56
62
60
58
48
50
52
72
74
66
70
124
27
32
12
38

42
40
26
50
154
32
150
152
S
S
62
60
146
124
34
164
156
72
140
10
136
36
160

16
22
24
142
12
138
98
82
18
88
86
80
78
92
14
96
90
94
92
46
44

EXERCISE EQUIPMENT

BACKGROUND OF THE INVENTION

1. Field of the Invention

This invention has relation to exercise equipment and more specifically to equipment which utilizes fluid resistance type exercising equipment.

2. Description of the Prior Art

Until quite recently, the most commonly used exercise device for muscle development was the barbell which comprised a bar with weights on opposite ends. The weight of the barbell could be varied by adding or removing weights from the ends of the bar. Use of barbells had a number of disadvantages including the time taken to change weights on the barbells to accommodate the capabilities of students in large classes, for example. Barbells are dangerous because of the ever present chance of a student "losing" a weight causing the barbell to fall. Also, muscle development cannot be concentrated in all parts of the body using barbells.

Heretofore, devices which use weights have a fixed weight and, for example, as the lower arm moves from extended position through the position with the elbows close to the body and the lower arm straight out and to a postion with the elbows down and the fists up to the shoulders, the force required to move the weight changes. Therefore, the arm is not equally stressed throughout its range of movement.

It is known to use equipment having activating means such as pivotably movable arms connected to hydraulic or fluid flow resistance cylinders to resist the movement of the user of the equipment in moving such actuating arms. In this regard, the following patents have been issued to Jerry D. Brentham:

U.S. Pat. No. 3,822,599 granted in July of 1974;
U.S. Pat. No. 4,066,259 granted in Jan. of 1978;
U.S. Pat. No. 4,020,627 granted in Dec. of 1980;
U.S. Pat. No. 4,185,818 granted in Jan. 1980;
U.S. Pat. No. 4,247,098 granted in Jan. of 1981;
U.S. Pat. No. 4,254,949 granted in Mar. of 1981;
U.S. Pat. No. 4,258,913 granted in Mar. of 1981;

A company known as "Nautilus" is known to have used elliptical pulleys with weights on the end of activating arms in an attempt to get equal resistance to movement over the entire range of movement.

Universal Athletic Sales of Fresno, Calif. beginning back in the 1954–55 era pioneered the use of weight loaded systems.

No specific search was made on the present invention. However, applicant and those in privity with him are aware of no prior art which is closer than that discussed above and they are aware of no prior art which anticipates the claims herein.

SUMMARY OF THE INVENTION

Equipment for exercising the muscles of a user by providing resistance to repetitive movements of specific body portions of the user includes a horizontally extending main frame adapted to be supported on a floor and including a bench supported in horizontal spaced relation to the floor. Actuating arms are movably mounted with respect to the main frame to be movable by the user in a first direction under resistance and to be movable in a second direction without resistance. Actuated means is fixedly mounted with respect to the main frame and includes a movable member movable in a first direction and in a second reverse direction, the actuating means providing resistance to movement when it moves in its first direction.

An elevator leg is integral with and extends substantially vertically upwardly from one end of the main frame, the leg providing a vertical guideway from its upper portion to its lower portion. An elevator carriage is mounted to ride in the guideway. An idler pulley and a driven pulley are rotatably mounted in a top portion and in a bottom portion of the elevator leg respectively. An endless chain or other endless flexible elevator band is operably mounted on the pulleys to have first and second substantially vertical portions or runs situated in parallel relation to each other and to the guideway. Means is provided to couple one of these vertical portions or runs to the elevator carriage. In the form of the invention as shown, this means is operable to couple, selectively and alternately, either one of the runs of the elevator chain or band to the carriage.

Means is provided to couple the movable member of the actuated means to the driven pulley to cause the movable member to move in proportion to the rotation of the driven pulley, this movable member of the actuated means moving in its first direction as the elevator band or chain moves in a first direction.

Means is provided for operably linking the actuating means to the elevator carriage to cause the elevator carriage to move in a first direction when the actuating means is moved in its first direction.

In one disclosure of the invention as shown, the actuating means is constituted as two rigid actuating arms together with means in the elevator carriage to retain these arms in position in the carriage during use of the exercise device for its intended purpose.

In accordance with another disclosure of the invention, the actuating means is constituted as a pair of actuating arms pivotably mounted to upper portions of vertical stanchions integral with and extending upwardly from the main frame. These pivoted actuating arms can move either in a vertical plane at right angles to the longitudinal axis of the main frame and bench, or can move in a pair of vertical planes spaced from and parallel to this longitudinal axis. A pair of circle segment pulleys are provided, each one integral with one of the actuating arms and concentric with the pivot point of that arm, and a pair of second flexible bands or chains are utilized. Each such chain is anchored at one end to one of the circle segment pulleys, extends around at least a segment of the pulley and is anchored at the other end to a bottom portion of the elevator carriage.

BRIEF DESCRIPTION OF THE DRAWINGS

FIG. 8 is a fragmentary sectional view of a central portion of the apparatus of FIG. 2 and disclosing a pair of pivotably mounted actuating arms installed to pivot in planes at 90° from the plane of those arms as seen in FIGS. 1 through 4.

DETAILED DESCRIPTION OF THE PREFERRED EMBODIMENTS

Figure 1:
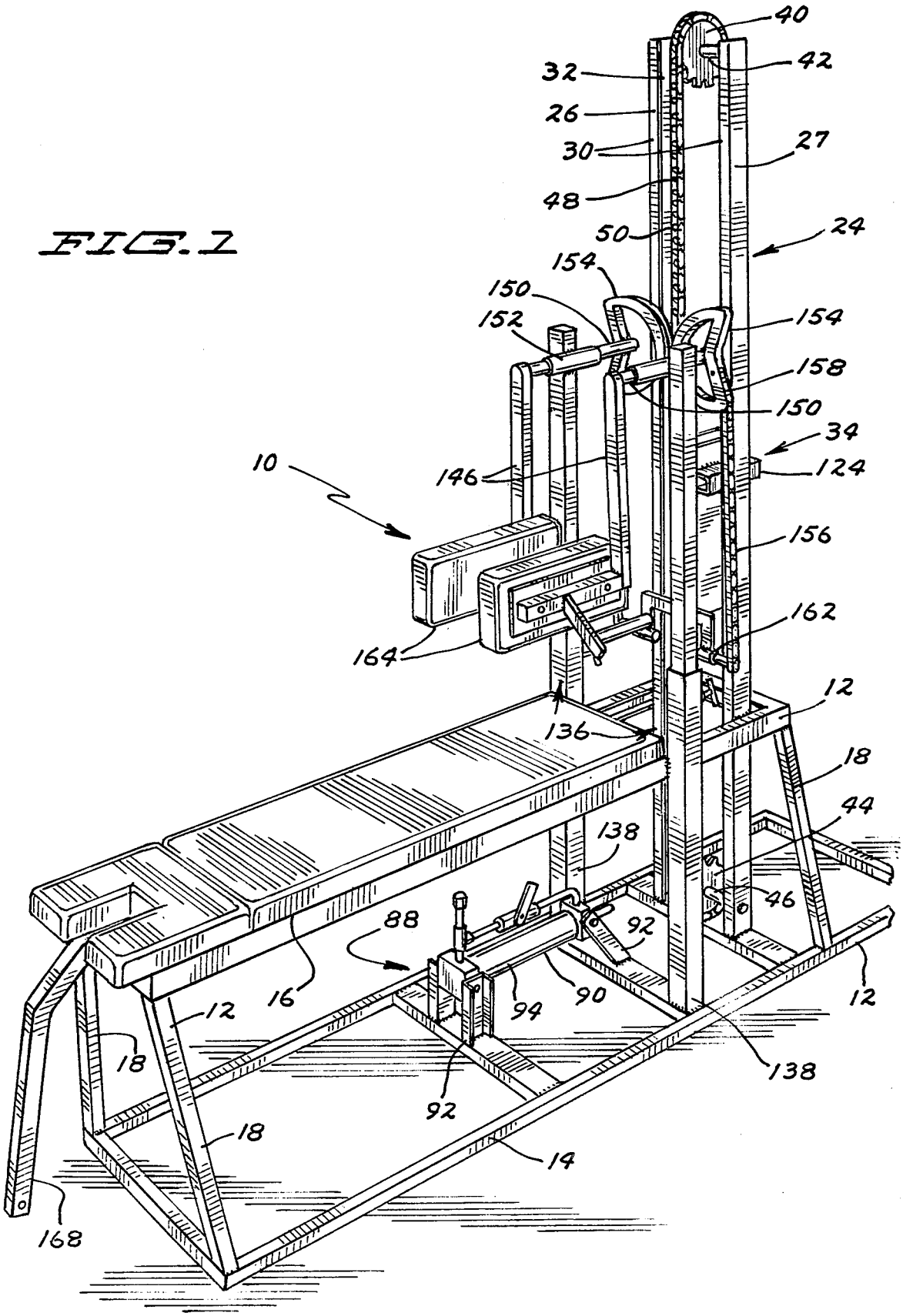
FIG. 1 is a perspective view of the exercise equipment of the invention but with the operative link between a hydraulic piston/cylinder pump and an elevator chain driven pulley being omitted for purposes of clarity.

Exercise equipment 10 includes a main frame 12 which has a base sub-frame 14 and a bench 16 supported in spaced parallel relationship with each other by appropriate frame legs 18 on a floor 20. A bench pad 22 covers the bench 16 and serves as a cushion for the user of the equipment when the user is called to rest some body portion on the bench.

At one end of the bench 16, the main frame 12 supports a vertically upwardly extending elevator leg 24. This elevator leg includes twin parallel masts 26 and 27 which, as shown, are constituted as channel irons welded to the main frame in position so that the channels are open and facing each other to provide an elevator guideway 30 which consists of facing spaced-apart guide tracks 32,32 each provided by one of the masts 26 or 27.

An elevator carriage 34 includes two vertically disposed guide wheels 36,36 running in one of the guide tracks 32 and two vertically disposed guide wheels 38,38 in the other track 32.

An idler pulley or wheel in the form of a chain sprocket 40 is pivotably mounted on an elevator idler shaft 42 at a top portion of elevator leg 24; while a driven wheel or pulley shown as a chain sprocket 44, is pivotably mounted on an elevator driven wheel shaft 46 on a bottom portion of the elevator leg. An endless driven flexible elevator band or chain 48 is operably mounted on the pulleys or sprockets 40 and 44 to have a first vertical portion or run 50 situated in spaced, parallel relationship. with a second vertical portion or run 52, both runs being parallel to, and lying between, the guide tracks 32,32 of the elevator guideway 30.

Figures 4, 5:
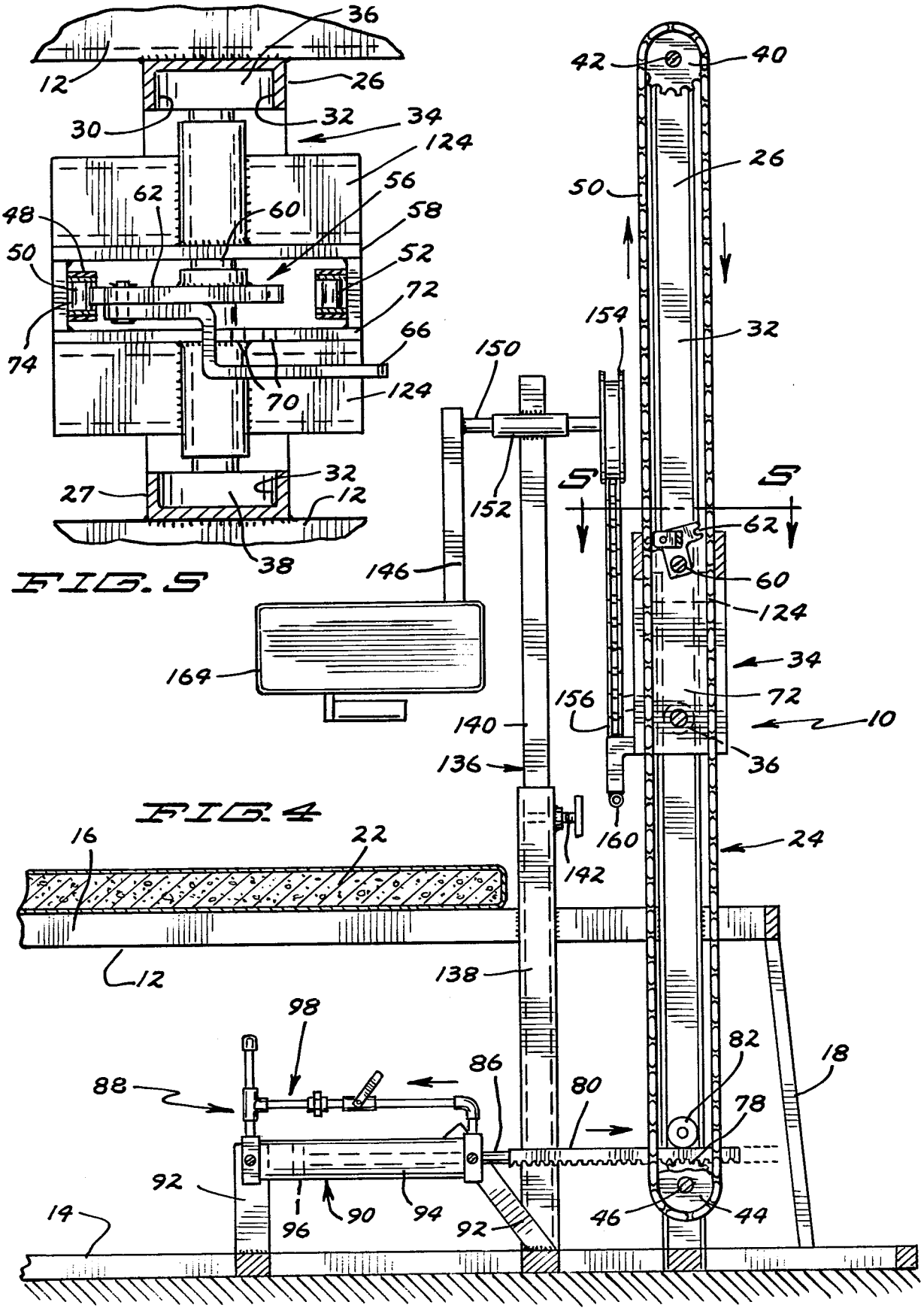
FIG. 4 is a fragmentary vertical sectional view taken generally on the line 4—4 in FIG. 3.
FIG. 5 is an enlarged horizontal sectional view taken on the line 5—5 in FIG. 4.
Figure 6:
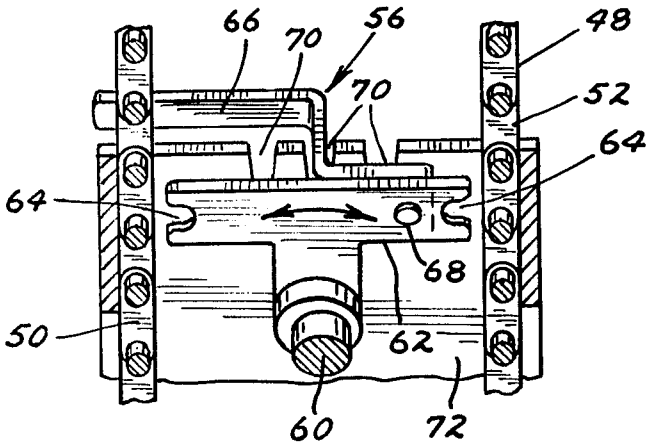
FIG. 6 is a fragmentary perspective view of the structure of FIG. 5 but taken from the rear of the apparatus as seen in FIG. 4.

As best seen in FIGS. 4, 5 and 6, elevator carriage coupling means 56 is pivotably mounted with respect to an upper portion of a first side plate 58 of elevator carriage 34 to couple that carriage to the first vertical run 50 of the endless elevator chain 48 as seen in FIGS. 4 and 5; to couple the elevator carriage to the second run of chain 48 (not specificially shown); or to be positioned out of coupling contact with either of the chain runs 50 and 52 as seen in FIG. 6 and as is necessary in order to adjust the height of the elevator carriage with respect to the elevator leg to adapt the equipment to perform any one of a large number of different motion resisting functions.

The elevator carriage coupling means includes a coupling means pivot pin 60 mounted in first side plate 58 of elevator carriage 34, a toggle bolt or locking bar 62 having chain bushing receiving openings 64 therein at opposite ends thereof the bar 62 being pivotably mounted on the axis of pivot pin 60, and a coupling means operating handle 66 pivotably mounted as at 68 to the toggle bolt or locking bar 62. As perhaps best seen in FIGS. 5 and 6, the operating handle 66 is offset so that it can be moved into and out of locking slots 70 which are provided in an upper edge portion of a second side plate 72 of the elevator carriage 34.

In operation of the elevator carriage coupling means 56, the operating handle 66 is lifted out of all of the locking slots 70 and is used to move the locking bar 62 to position so that one of the chain bushings 74 of the endless driven chain 48 is received into one of the receiving openings 64 of the locking bar, and the handle 66 is then placed in the appropriate locking slot 70 to maintain the elevator carriage in locked relationship with one of the runs 50 or 52 of the chain 48. In FIGS. 4 and 5, the coupling means 56 is illustrated as locking the carriage to the first run 50 of the chain. That vertical portion or run 50 will thereafter move up and down with the up and down movement of the elevator carriage 34 so long as the coupling means stays in that position.

Figures 2, 3:
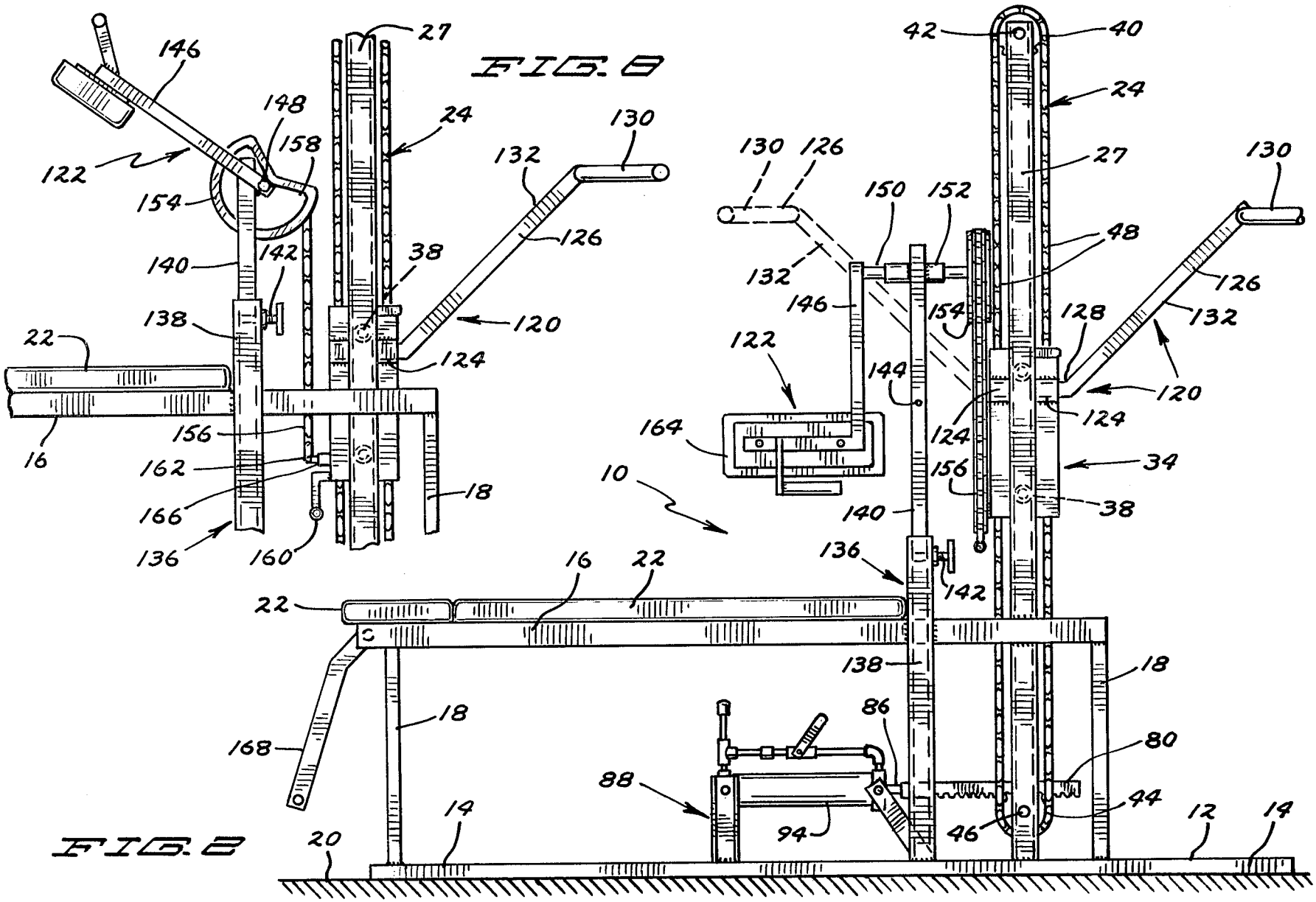
FIG. 2 is a side elevational view of the apparatus of FIG. 1.
FIG. 3 is an end elevational view of the apparatus of FIGS. 1 and 2.
Figure 3:
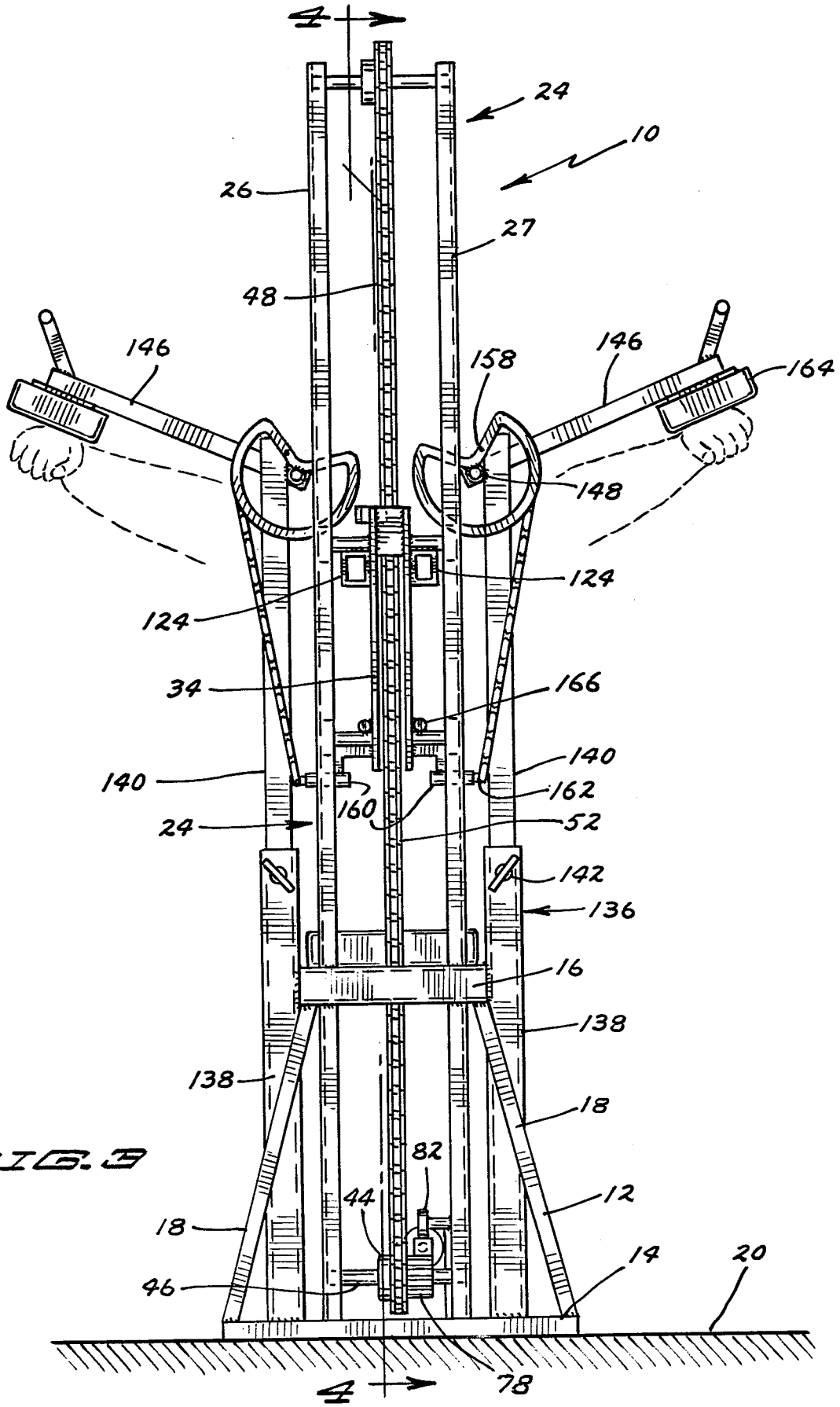

As perhaps most clearly seen in FIG. 3, a driven pinion gear 78 is integral with the driven chain sprocket 44 and is concentric therewith on driven wheel shaft 46. An actuated means drive rack 80 is in operative relationship to the driven pinion gear 78 and is held in that relationship by a rack hold-down wheel 82 mounted on the elevator leg 24. This rack extends integrally outwardly from and in alignment with a piston rod 86 of an actuated means 88.

Actuated means 88, in the form of the invention shown, consists of a positive displacement linear pump 90 fixedly mounted with respect to the main frame 12 on actuated means support legs 92,92. Pump 90 includes a cylinder 94 and a piston 96 operably mounted on an inside surface of the cylinder.

Figure 7:
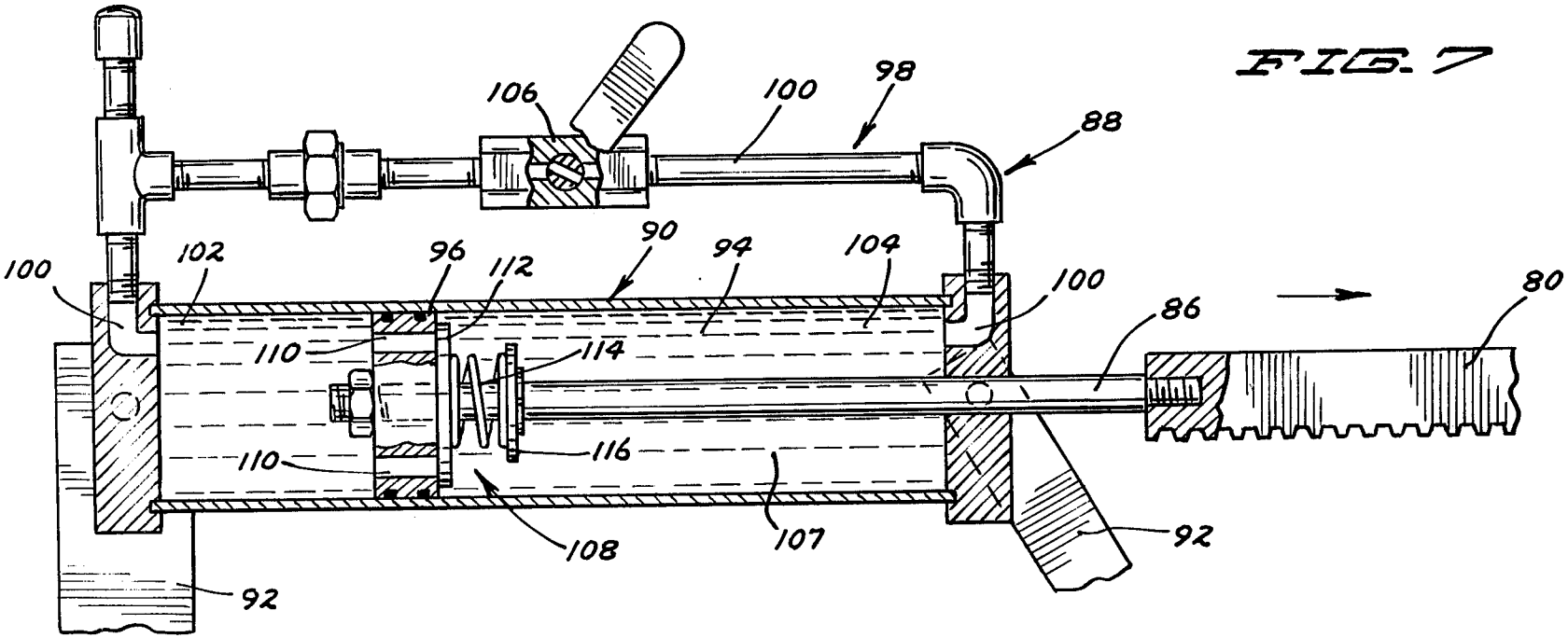
FIG. 7 is an enlarged fragmentary view of an actuated means as seen in FIGS. 2 and 4 but with parts in section and parts broken away.

A means 98 for providing resistance to movement of the piston 96 in the cylinder 94 in a first direction from the left to the right as seen in FIGS. 1, 2, 4 and 7, includes a conduit 100 open from a closed end 102 of the cylinder 94 to a rod end 104 of the cylinder, and an adjustable manually operable flow control valve 106 in conduit 100 and shown more or less conventionally in FIG. 7. This valve 106 can be of any usual or preferred construction. The size of the passageway through the valve 106 controls the force being resisted by the actuated means 88.

The cylinder 94 and conduit 100 are filled with hydraulic fluid 107.

The arrangement of the parts is such that when the user quits putting force on the actuating means in a first direction, he can move the actuator means without appreciable force in the second direction. This is accomplished by provision for a one-way quick relief valve 108 including and associated with the piston 96. This relief valve 108 includes a plurality of relief valve openings 110 through piston 96. These openings are covered on the movement of the piston 96, piston rod 86, and rack 80 in the first direction by a lightweight aluminum valve disc 112 which lies in concentric encircling relationship to the piston rod 86 and in covering relationship to the relief valve openings 110. A very light relief valve spring 114 is held by a washer 116 on fixed piston rod 86, to bear against the valve disc 112 so that when the user moves the activating means in its second direction, the quick relief valve disc 112 will move instantly away from the relief valve openings 110 in the piston 96, and the return movement of the actuating means in the return direction will be accomplished without any appreciable effort on the part of the user.

In accordance with the invention, a very large number of arrangements are contemplated for the actuating means. These can be divided into two main categories, however. A first set of actuating means 120 which are attached generally to the elevator carriage 34, and a second set of actuating means 122 which are pivotably mounted with respect to the main frame 12 and which are attached to the elevator carriage 34 through the instrumentality of a flexible band or chain.

In connection with the first set of actuating means 120, the elevator carriage 34 is provided with a first pair of rectangular sockets 124,124 lying on parallel, spaced-apart horizontal axes, mutually parallel with the axis of the bench 16 of the main frame 12, and extending on either side of the endless chain 48. Two rigid first actuating arms 126,126 each have a rectangular socket end 128 and an offset handle end 130 situated in parallel relationship to the socket end and connected to it by a shank portion 132 of the arm 126.

To use the exercise equipment to perform the "squat press" exercise, the first actuating arms 126,126 will be assembled with the exercise equipment as seen in full lines in FIGS. 2 and 8. With the elevator carriage 34 linked or coupled to the first run 50 of the endless chain 48 at the proper height to begin the exercise, and with the piston 96 at the left limit of its travel within the cylinder 94 as seen in FIG. 7, the user will squat on the right extension of the base sub-frame 14 with his back to the elevator leg with the handle ends 130 over his shoulders and with his hands on the handle ends. The user will then stand to elongate his body, this movement being resisted by the actuated means in the manner set out above. When the user gets to a full standing position, he will again take the squat position, the relief valve will operate, and the piston will once again come back to the left end of its motion in the cylinder as seen in FIG. 7.

By removing the first actuating arms 126,126 from sockets 124,124, rotating each arm through 180° and then reinstalling them in the sockets, and with the elevator carriage still coupled to the first run 50 of the chain, the equipment is in position to peform the "dead lift" exercise.

With the first actuating arms 126,126 installed as seen in dotted lines in FIG. 2, for example, and with the user seated on the bench facing the elevator leg 24, the equipment can be used to perform the "military press". With the user lying on his back, this same setup can be used to perform the "bench press" and, reversing his position, to perform the "leg press".

With the first actuating arms installed 180° from the position shown in dotted lines in FIG. 2, the equipment can again be used to perform the "dead lift".

Other exercises can also be performed with the first actuating arms 126,126 positioned directly in the elevator carriage 34 in one of the four positions described.

Turning now to the second set of actuating means 122, these means include telescoping stanchions 136,136. Each stanchion is made up of a rectangular hollow stanchion base member 138 and a height-adjustable upper stanchion member 140. A stanchion fastening pin 142 is threadably mounted in an upper portion of the stanchion base member 138 and is designed to pass through the base member and to pass through one of two sets of fastening pin openings 144 extending horizontally through the upper stanchion member 140.

Two rigid second actuating arms 146,146 are pivotably mounted as at 148, one at an upper end of each of the upper stanchion members 140. As seen in FIGS. 1, 2, 3 and 4, each of these arms 146,146 are integral with an actuating arm pivot shaft 150 which is rotatably mounted in a pivot collar 152 integral with the upper stanchion member 140.

At the opposite end of each actuating arm pivot shaft 150, there is integrally mounted one of a pair of circle segment pulleys 154. As best seen in FIG. 3, a flexible band or chain 156 is anchored at 158 to its pulley 154, extends around through the pulley groove, and is anchored to one of a second pair of anchor sockets 160 which are integral with the lowermost portions of elevator carriage 34.

In the form of the invention as shown, the end of flexible chain 156 opposite the end that is pinned to pulley 154 is provided with a simple bolt-like anchor pin 162.

Outer ends of the second actuating arms 146,146 are provided with cushions or pads 164,164.

With the user sitting astride bench 16 and facing elevator leg 24, and with the user's wrists placed in front of him and in contact with the interior facing surfaces of the cushions 164, when positioned as seen in FIG. 2, the user can perform the "shoulder fly" exercise by repeatedly moving his arms to the position as seen in dotted lines in FIG. 3. This movement causes the chains 156 to move the elevator carriage in upward direction against the resistance of actuated means 88 when the carriage is coupled to first run 50 of endless chain 48. Other exercises which can be done with this positioning of the equipment include "chest flies" which are performed with the user lying face up on the bench with head toward the elevator leg.

The second actuator arms 146 can be installed at 90° to the position seen in FIGS. 1, 2, 3 and 4. This is done by removing the stanchion fastening pin 142 from the upper stanchion member 140 and the hollow stanchion base member 138, removing the upper stanchion member 140 from within the hollow base member and turning it to bring the second actuating arms 146,146 into alignment as seen in FIG. 8 and then replacing the upper stanchion member 140 into the base member 138 and reinserting the stanchion fastening pin through the base member 138 and through the uppermost of the fastening pin openings 1444 in each of the upper stanchion members 140.

With the parts so positioned, and with the flexible chain 156 pinned as at 158 as seen in FIG. 8 to the circle segment pulleys 154, the bolt-like anchor pins 162 are inserted into third anchor sockets 166 which are also integral with a lower portion of the elevator carriage 34.

With the apparatus so positioned, the "tricept pushdown" exercise can be accomplished.

Many other exercises can be performed using the concept of invention. For example, leg extension and leg flexion can be accomplished by providing transversely extending leg cushions fixedly mounted on the lower end of a acutating leg 168, and by running a tension wire or other appropriate linkage around the pulley adjacent a bottom portion of the elevator leg and up to a position anchored in anchor sockets 160, for example. Further, with the first actuating arms 126,126 positioned as seen in dotted lines in FIG. 2, for example, the positioning of the elevator carriage coupling means 56 can be reversed to couple the elevator carriage 34 to the second run 52 of the chain 48, and the equipment can be used for "pushdowns".

Although the present invention has been described with reference to preferred embodiments, workers skilled in the art will recognize that changes may be made in form and detail without departing from the spirit and scope of the invention.

What is claimed is:

1. Equipment for exercising the muscles of a user by providing resistance to repetitive movements of specific body portions of the user, said exercise equipment including:

A. a horizontally extending main frame;

B. actuating means;

C. means for movably mounting the actuating means with respect to said main frame to be movable by the user in first and second directions;

D. actuated means fixedly mounted with respect to the main frame and including a movable member movable in a first direction and in a second reverse direction, said actuated means providing resistance to the movement of said movable member when it is moving in its first direction;

E. an elevator leg integral with and extending substantially vertically upward from the main frame, said elevator leg providing a vertical guideway extending from its upper portion to its lower portion;

F. an elevator carriage mounted to ride in said guideway;

G. an idler pulley and a driven pulley, one rotatably mounted in a top portion and the other in a bottom portion of said elevator leg;

H. an endless driven flexible elevator band operably mounted on said pulleys to have first and second mutually parallel, substantially vertical runs situated in parallel relation to said guideway;

I. means to operably couple one of said runs of the elevator band to the elevator carriage;

J. said means for mounting the actuating means including means for operably linking the actuating means to the elevator carriage to cause the elevator carriage to move in a first direction when said actuating means is moved in its first direction;

K. means operably coupling the movable member of the actuated means to the driven pulley to cause the movable member to move in proportion to the rotation of the driven pulley, the movable member of the actuated means moving in its first direction as the elevator band moves in its first direction;

L. wherein the main frame includes a base sub-frame adapted to be supported on a floor and a bench above the sub-frame supported in spaced, parallel relation to the sub-frame to have a longitudinal axis parallel to a plane containing the endless elevator band;

M. wherein said actuated means includes a positive displacement pump and means to restrict the output of said pump, said actuated means movable member being operably associated with the mechanical drive of the pump;

N. wherein the elevator leg is constituted as twin, parallel, spaced-apart masts and the elevator guideway is constituted as a pair of guide tracks in parallel, facing relation to each other, each track being provided by one of the twin masts;

O. wherein said flexible elevator band is constituted as an endless chain and said driven pulley is constituted as a chain-receiving sprocket;

P. wherein the pump includes a closed-ended, hollow cylinder, a piston operably associated with the interior of the cylinder and a piston rod extending outwardly through an end wall of the cylinder to constitute part of the movable member, the actuated means further including hydraulic fluid in the cylinder, a path for hydraulic fluid between first and second ends of the cylinder, and means for providing resistance to flow of such fluid from one end of the cylinder to the other as said actuated means movable member is forced to move in its first direction;

Q. wherein the actuating means is pivotably mounted with respect to the main frame and the means for operably linking the actuating means to the elevator carriage includes a second flexible band extending between the actuating means and the carriage;

R. wherein a pair of stanchions extend integrally upwardly from the main frame on a side of the elevator leg adjacent the bench; and S. wherein the actuating means includes:

(1) a pair of actuating arms pivotably mounted to upper end portions of the stanchions, (2) a pair of circle segment pulleys, each integral with one of the actuating arms and concentric with its pivot point, and (3) a pair of second flexible bands, each anchored at one end to one of the circle segment pulleys, extending around at least a segment of said pulley and anchored at the other end to a bottom portion of the elevator carriage.

2. The equipment of claim 1 wherein:

T. the actuating arms pivot in a plane at right angles to the longitudinal axis of the bench.

3. The equipment of claim 1 wherein:

T. the actuating arms pivot in planes parallel to the longitudinal axis of the bench.

4. Equipment for exercising the muscles of a user by providing resistance to repetitive movements of specific body portions of the user, said exercise equipment including:

A. a horizontally extending main frame including a base sub-frame adapted to be supported on a floor and a bench above the sub-frame supported in spaced, parallel relation to the sub-frame, the bench having a horizontal longitudinally extending main axis;

B. an elevator leg integral with and extending substantially vertically upwardly from the main frame, said elevator leg providing a vertical guideway extending from its upper portion to its lower portion;

C. an elevator carriage mounted to ride in said guideway;

D. an idler pulley and a driven pulley, one rotatably mounted in a top portion and the other in a bottom portion of said elevator leg each being mounted in fixed position with respect to the other;

E. an endless driven flexible elevator band operably mounted on said pulleys to have first and second mutually parallel, substantially vertical runs situated in parallel relation to the guideway;

F. means to operably couple one of the runs of the elevator band to the elevator carriage;

G. a pair of stanchions extending integrally upwardly from the main frame in parallel spaced relation to the elevator leg and adjacent the first end of the bench;

H. actuating means including a pair of actuating arms pivotably mounted to upper end portions of the stanchions to be movable by the user in first and second directions;

I. actuated means fixedly mounted with respect to the main frame and including a movable member movable in a first direction and in a second reverse direction, said actuated means providing resistance to movement of the movable member when moving in its first direction;

J. means for operably linking the actuating means through the elevator carriage and the endless elevator band to the driven pulley to cause the driven pulley to rotate in a first direction when said actuating means is moved in its first direction; and K. means operably coupling the movable member of the actuated means to the driven pulley to cause said movable member to move in proportion to the rotation of the driven pulley, the movable member of said actuated means moving in its first direction as the actuating means moves in its first direction.

* * * * *